US005921191A

United States Patent [19]

Gabel

[11] Patent Number: 5,921,191

[45] Date of Patent: Jul. 13, 1999

[54] PASS THROUGH INTERLOCK SYSTEM

[76] Inventor: Bernard R. Gabel, 17590 Burkwood Cr., Yorba Linda, Calif. 92886

[21] Appl. No.: 08/755,737

[22] Filed: Nov. 25, 1996

[51] Int. Cl.[6] ..... E05G 7/00

[52] U.S. Cl. ..... 109/7; 49/68; 109/13; 109/68

[58] Field of Search ..... 109/2–8, 12, 13, 109/67, 68; 49/68; 312/242, 286

[56] References Cited

U.S. PATENT DOCUMENTS

| | | | |
|---|---|---|---|
| 1,008,125 | 11/1911 | Eichelkraut | 109/7 |
| 2,077,055 | 4/1937 | Plym | 109/7 |
| 2,079,824 | 5/1937 | Smeaton et al. | 109/7 |
| 3,100,389 | 8/1963 | Noregaard | 109/68 |
| 3,669,038 | 6/1972 | Watson | 109/12 |
| 3,711,993 | 1/1973 | Liesch et al. | 49/68 |
| 4,024,729 | 5/1977 | Abate, Sr. et al. | 312/218 X |
| 4,481,887 | 11/1984 | Urbano | 109/3 |
| 4,643,106 | 2/1987 | Aragona | 109/6 |
| 4,656,954 | 4/1987 | Tonali | 109/6 |
| 4,741,275 | 5/1988 | Lewiner et al. | 109/7 |
| 4,763,937 | 8/1988 | Sittnick, Jr. et al. | 70/277 X |
| 5,099,623 | 3/1992 | Smith et al. | 52/201 |
| 5,195,448 | 3/1993 | Sims | 109/6 |
| 5,400,557 | 3/1995 | Glover | 52/201 |
| 5,458,287 | 10/1995 | Jones et al. | 52/201 X |
| 5,694,867 | 12/1997 | Diaz-Lopez | 109/7 X |

FOREIGN PATENT DOCUMENTS

| | | | |
|---|---|---|---|
| 0176587 | 7/1991 | Japan | 52/201 |
| 7308642 | 12/1974 | Netherlands | 109/7 |
| 2224773 | 5/1990 | United Kingdom | 70/277 |

*Primary Examiner*—Lloyd A. Gall
*Attorney, Agent, or Firm*—Cleveland R. Williams

[57] ABSTRACT

Pass through interlock systems for sanitized environments or "clean rooms" are disclosed which allow for the transfer of objects from outside the sanitized environment without introducing undesirable contaminants therein. The system comprises a frame, box like structure juxtaposed on the back end of a frame, two doors oppositely disposed to each other, an electric mortise lock with solenoid or electric motor, first and second sensors and an electronic controller with power source, that is programmed to automatically lock one door when the opposite door is opened.

18 Claims, 4 Drawing Sheets

FIG. 2

PASS THROUGH INTERLOCK SYSTEM

BACKGROUND OF THE INVENTION

1. Field of the Invention

This invention relates to pass through interlock systems for sanitized environments. The system comprises a frame adapted to fit into a wall, a first door containing a sight window, electric mortise lock with outside manual handle. A rectangular, box like structure is juxtaposed on the back side of the frame; said box like structure containing a second door similar to the first door and is attached to the front of said box like structure. First sensor means comprising a manual switch is located in the electric mortise lock. An electronic controller with external power source connects the first and second sensors and electric mortise lock in such a manner that only one of the doors can be opened at a given time. The box like structure and frame have a passage way there through.

Currently, in many areas of the high tech industry it is desirable to manufacture products in a sanitized room or environment because contaminants can cause these products to malfunction. Thus, industries such as the computer, aerospace, radar, satellite, etc. industries produce these products in sanitized environments to protect said products from contaminants. These environments often have positive air pressure to prevent the introduction of contaminants therein. One major problem associated with these type environments is the unwitting introduction of contaminants into the environment when some individual opens a door to enter or exit said environment. This problem is solved by utilizing the pass through interlock system herein. The system is built into a wall and allows items to be passed there through without contaminating the sanitized environment. This is accomplished by utilizing first and second sensor means, an electric mortise lock, and interlock control means in combination with other elements of the system. When an individual opens one door of the system, the electronic control means automatically locks the other door. An item is placed in the interlock system and the door is closed. The electronic control means unlocks the previously locked door and an individual on the other side of the pass through system can unlock said door and retrieve the item in the passage way. The system automatically locks the opposite door when a door in the system is opened. This device and system prevents or greatly reduces the possibility of introducing contaminants into a sanitized environment.

2. Description of the Prior Art

Numerous attempts have been made in the past to construct devices which limit or protect a room or building from automatic entrance therein by individuals. The vast majority of these devices, however, are constructed for security considerations.

For example U.S. Pat. No. 4,481,887 to Urbano, relates to a security door and system for installation as the entrance and exit to a building or office. The system consists of a vestibule having side walks and oppositely disposed doors which open and close automatically. Photocells energize motors which open a respective door through which a person may enter the unit. The respective door is then automatically closed and after a predetermined time delay, the second door opens and allows the individual to proceed.

U.S. Pat. No. 3,669,038 to Watson, describes an order transfer assembly for preventing holdups. The device consists of a one-way delivery chamber adapted to be located in a building wall. The device provides a delivery chamber into which an attendant can place a requested order after first receiving payment, he then closes a door on his side and by remote control, opens the door on the customer's side, permitting the latter to remove his order. Part or all of the chamber may be constructed of bullet proof glass.

U.S. Pat. No. 4,643,106 to Aragona relates to a safety lock device that is disposed on the inside of an outside door leading to a vestibule. When manually actuated from inside the vestibule, the lock throws a dead bolt for a predetermined period of time. This allows the user a certain amount of time and security to gain access to a building through a key activated lock on an inner door.

U.S. Pat. No. 4,656,954 to Tonali, describes an autodirecting security entrance for banks and similar buildings. The device consist of a security entrance with a box type shape and containing interlocked doors. The device is equipped with a metal detector to detect the presence of weapons on an individual. When a weapon is detected by the metal detector the doors are automatically locked, an alarm is sounded and a controller sitting in a kiosk adjacent to the security entrance makes a decision to unlock the doors and allow the individual to proceed or call the authorities.

U.S. Pat. No. 4,741,275 to Lewiner, et al., relates to a device for controlling an access of the security chamber type which consists of at least two doors, each of which is equipped with a lock containing electronically controlled locking and a control device for applying to the security chamber a variety of predetermined programs to lock and unlock the doors.

U.S. Pat. No. 5,195,448 to Sims, describes a security system which allows an individual to enter or exit an establishment through a plurality of floor to ceiling extending walls and lockable doors made of bullet resistant materials, the sum of which form a completely enclosed bullet resistant vestibule. Means for detecting the movement of individuals through the doors is provided by floor mat switches, infra-red sensors and door position sensors. Individuals are allowed unhampered entry to the establishment through the security system, but prevented from exiting said establishment unless so enabled by an employee.

As can readily be determined from the foregoing there is an ongoing research effort and a need to develop and produce new and novel pass through and entrance systems for rooms and buildings.

SUMMARY OF THE INVENTION

The present invention resides in a pass through interlock system for sanitized environments. The interlock system comprises a frame adapted to fit in a wall between a sanitized environment and an outside environment. A first door is attached to a front portion of a frame. A box like structure containing a second door attached to a front side thereof, is removably attached to the back side of the frame. The two doors are oppositely disposed to each other and are further defined by a passage way from the first door through the frame and box like structure to the second door. Interlocking means comprising modified, electronic mortise locks are attached to the first and second doors. The electric mortise locks contain outward handles for manually opening and closing said locks. First sensing means consisting of a manual, position switch is contained in each electric mortise lock, which interrupts a signal from electronic control means when the handle of the electric mortise lock is manually opened. The interrupted signal then activates the electronic control means, which in turn activates a solenoid or motor located in the electric mortise lock of the opposing door, effectively locking said door. Second sensor means consisting of magnetic proximity sensors are attached to a top portion of the front of the frame and box like structure, and magnets are attached to the top portions of the first and second doors. When one of the doors is opened, the magnetic proximity sensor, located near the particular door, is deenergized which in turn signals the electronic control means to activate the lock on the opposing door. The electronic control means is programmed so as to allow only one of the two doors to be opened at any given period of time.

BRIEF DESCRIPTION OF THE DRAWINGS

The invention is further described by reference to the appended drawings taken in conjunction with the following description where.

DETAILED DESCRIPTION OF THE INVENTION

Figure 1:
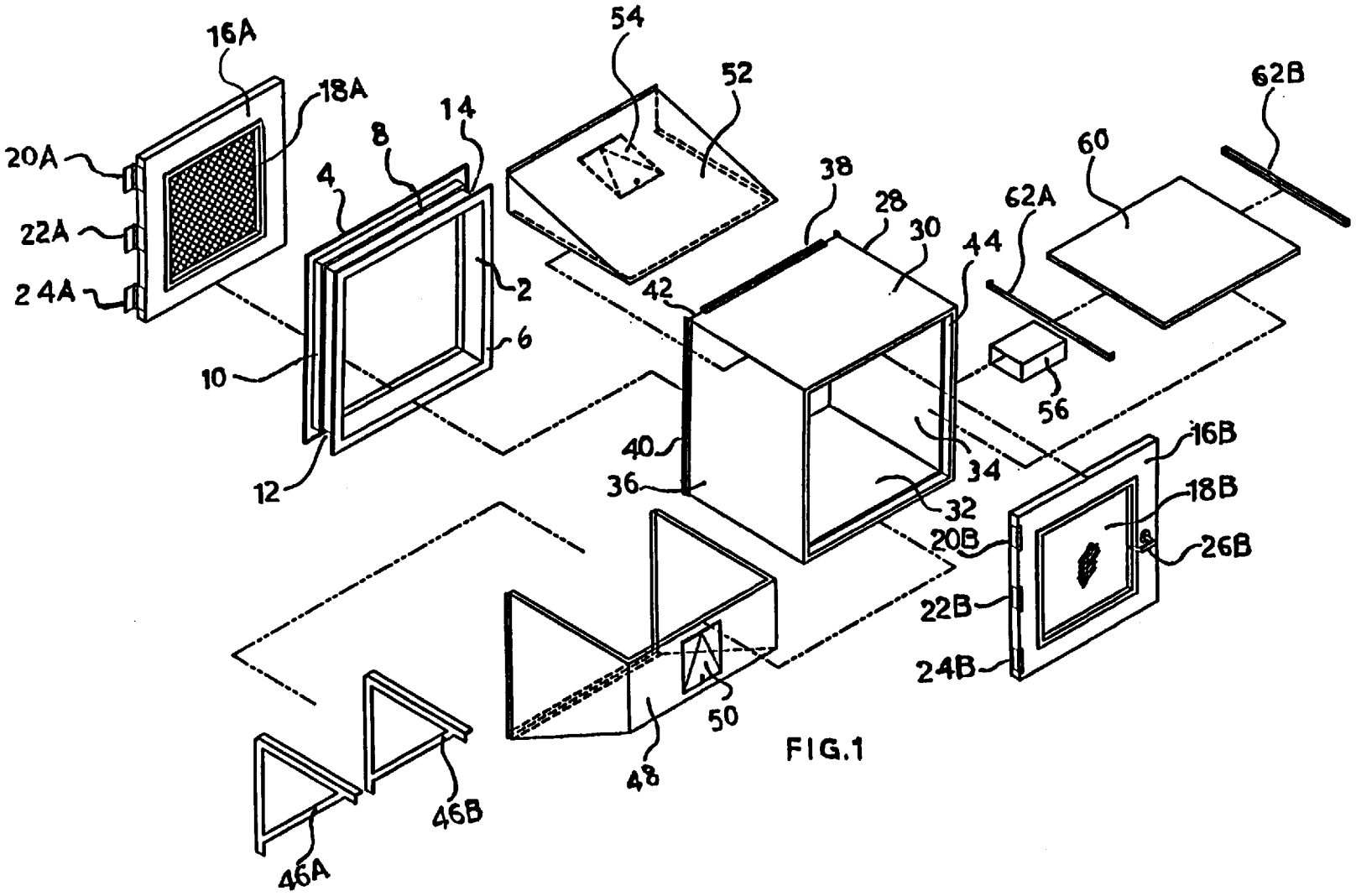
FIG. 1 is an exploded, frontal-perspective view showing a frame, box like structure containing hood, skirt and angle support brackets. First and second doors containing see through windows, door hinges and electric mortise locks are adjacent to the respective fronts of the frame and box like structure. Electronic control means is located near the bottom portion of the box like structure and vertical and horizontal clips are located near the top, bottom and sides of said structure. A removable support shelf, which is an optional embodiment herein, is also shown.

This invention resides in a pass through system for sanitized environments or "clean rooms" in high tech industries, such as, the computer, aerospace, radar, and satellite industries to name a few. Sanitized environments are necessary in manufacturing products in these industries because the smallest contaminants, for example, dust particles can cause these products to malfunction if introduced into the environment or room in which these products are constructed. Most contaminants are introduced in a sanitized environment or clean room when an individual either enters or exits said room. These rooms preferably have positive air pressure to help prevent the introduction of contaminants therein. Positive pressure is not 100 percent effective in eliminating the probability and possibility of introducing unwanted contaminants into a sanitized environment. This problem is conveniently solved by utilizing a pass through interlock system as substantially described and claimed herein.

The pass through interlock system herein comprises a frame which is adapted to fit into a wall, the back portion of a box like structure having a rectangular configuration is juxtaposed on the back portion of said frame. A first door and a second door are attached to the front of the frame and box like structure respectively. The two doors are oppositely disposed to each other and are further defined by a passage way from the first door through the frame and box like structure to the second door.

An electric mortise lock containing solenoid or electric motor and first sensing means is electronically connected with second sensing means and an electronic controller. The electronic controller is connected to a power source and is programmed to automatically lock one door when the opposite door is opened.

Embodiments of the pass through interlock system of the present invention are hereinafter described with reference to the drawings, in which identical or corresponding parts are indicated by the same reference characters or numbers through the several view.

FIG. 1 illustrates an exploded, front-perspective view showing frame 2, front side 4, back side 6, right side 10 (as viewed from the front), left side 14, top 8 and bottom 12. First door 16A containing sight window 18A is attached to frame 2 by load bearing hinges 20A and 24A. Central hinge 22A is an AC51 series electric hinge manufactured and marketed by Architectural Control Systems, Inc. located at 10666 Gateway Blvd., St. Louis, Mo. 63132. Central hinge 22A is especially designed to provide concealed low voltage current transfer to electrified mortise or cylindrical locks.

Box like structure 28 has a rectangular type configuration with top 30, bottom 32, right side 36, left side 34, front side 44 and back side 38. Second door 16B is attached to front side 44 of box like structure 28 by load bearing hinges 20B and 24B. Central hinge 22B is the same as central hinge 22A on first door 16A. Both central hinges 22A and 22B serve the same function, namely to transfer electric current between electronic controller 56 and electric mortise locks 26B and 26A (not shown). Second door 16B contains sight or see through window 18B. Electronic controller 56 is preferably located and attached to the bottom portion 32 of box like structure 28. Hood 52 is located on the top portion 30 of box like structure 28 and contains access port 54. It should be noted that in an alternate embodiment of the invention, electronic controller 56 can be located and attached to the top portion of box like structure 28. Access port 54 allows access to electronic controller 56 in this situation.

Electronic controller 56 is a modified controller which provides central control and monitoring of electromechanically operated doors. This modified unit is especially designed and manufactured by Architectural Control Systems, Inc., located in St. Louis, Mo.

In normal operation, first door 16A and second door 16B remain unlocked. When either door 16A or 16B is individually opened, electronic controller 56 is programed to automatically lock the opposing door, thus preventing both doors from being opened at the same time.

Angle support brackets 46A and 46B attach to a wall (not shown) just under box like structure 28 and provide support for box like structure 28. Conventional attachment means are used to attach support brackets 46A and B to a wall. Skirt 48 attaches to the bottom of box like structure 28 and a wall (not shown) just under box like structure 28 using conventional means.

Removable shelf 60 is an optional feature of this invention and is held in position in the interior of box like structure 28 by support brackets 62A and B. The back side or portion 42 of box like structure 28 is juxtaposed and contacts but is not physically attached to the back side or portion 6 of frame 2. Box like structure 28 is held in position by support brackets 46A and B, and by vertical clip 40 and horizontal clip 38. Vertical clip 40 is Z shaped in configuration, wherein one end of said vertical clip 40 is attached to the right 36 and left 34 sides of the back portion 42 of box like structure 28 using conventional attachment means and the other end fits around the right 12 and left 14 sides of frame 2. Horizontal clip 38 is W shaped in configuration, wherein one end of said horizontal clip 38 is attached to the top 30 and bottom 32 portions of the back side 42 of box like structure 28 and the top and bottom section or portion of a wall (not shown) located just above and below the top 8 and bottom 12 of frame 2. W shaped clip 38 is attached to box like structure 28 utilizing conventional means.

It should be noted that the pass interlock systems of this invention are further defined by a passage way extending from first door 16A through frame 2 and box like structure 28 to second door 16B.

Electric mortise lock 26B is located in a second door 16B. Electric mortise lock 26B contains an outside handle which manually opens said door 16B when an operator activates it. Mortise lock 26B contains a solenoid or electrical motor (not shown) and first sensor means (not shown), e.g. a manual electrical switch which opens and breaks an electrical current between electronic controller 56 and said electric mortise lock 16B when activated. Electric mortise lock 26B is especially modified, designed and manufactured by Architectural Control Systems, Inc. located in St. Louis, Mo., for the pass through interlock systems herein.

Figure 2:
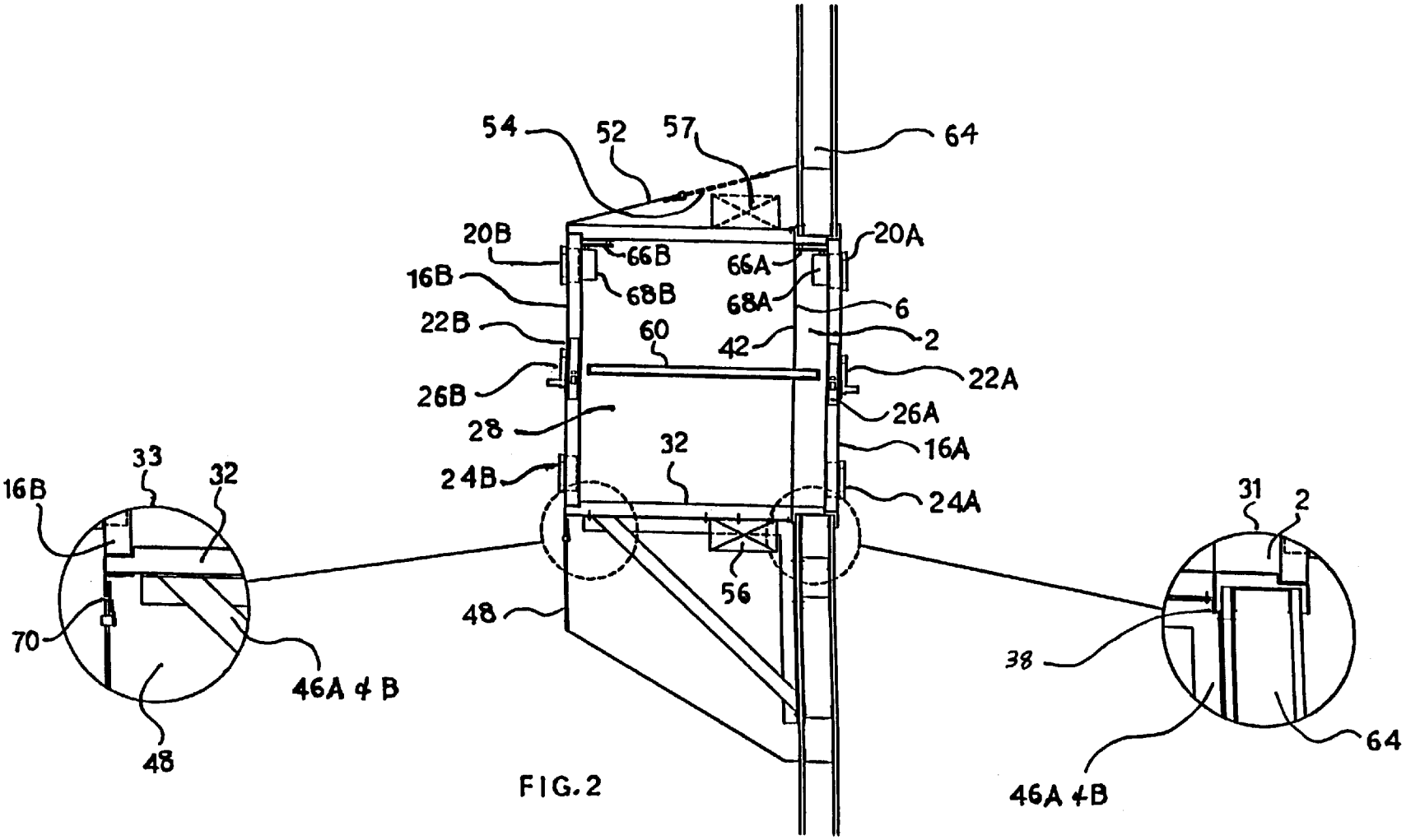
FIG. 2 is a cut-away, side view of the frame and box like structure of FIG. 1 showing the various elements thereof.

FIG. 2 is a side, cut-away view of the pass through interlock system herein which shows frame 2 inside wall 64. Load bearing hinges 20A and 24A attach first door 16A with frame 2. Central hinge 22A transfers electric current from electric mortise lock 26A to electronic controller 56 or alternatively 57.

Second sensor 66A comprises a magnet proximity sensor which is electrically energized when door 16A is closed and magnet 68A which is located near the top inside of door 16A and is in close proximity to sensor 66A. Second sensor 66A is de-energized when first door 16A is opened. This action breaks an electrical circuit between second sensor 66A and electronic controller 56, which in turn activates a solenoid in electric mortise lock 26B, locking the opposing, second door 16B.

Shelf 60 is an alternate embodiment of this invention and is located in the interior of box like structure 28. Second door 16B is connected to the front of box like structure 28 by load bearing hinges 20B and 24B. Central hinge 22B, electric mortise lock 26B, second sensor 66B and magnet 68B are the same as and perform the identical functions of their counter parts on first door 16A.

It should be noted that first door 16A and second door 16B remain unlocked when both doors are in the closed position. When one door is opened either the first sensor located in electric mortise lock 26A or 26B, depending upon which door is opened, a signal is electrically transmitted to electronic controller 56 which activates a solenoid or electric motor in the opposing door, thus automatically locking said door. Second sensors 66A and 66B in conjunction with magnets 68A and 68B perform the same function. The first and second sensors working in tandem with each other virtually assures that only one door of the pass through interlock system herein can be opened at a given period of time.

The back side or portion 42 of box like structure 28 is juxtaposed on and in contact with the back side or portion 6 of frame 2 where it is supported by angle, support brackets 46A and B.

Blown up view 31 shows the bottom portion of frame 2, wall 64, box like structure 32 (bottom portion) and support brackets 46A and B. W shaped, horizontal clip 38 is located near the bottom portion 32 of box like structure 28 where it attaches thereto, fits around the bottom portion of frame 2 and attaches to wall 64 using conventional attachment means.

Skirt 48 attaches to the bottom portion 32 of box like structure 28 using conventional attachment means. View 33 is a blown-up view which shows second door 16B, the bottom portion 32 of box like structure 28, support brackets 46A and B, and clip on attachment means 70 for bottom skirt 48.

Figure 3:
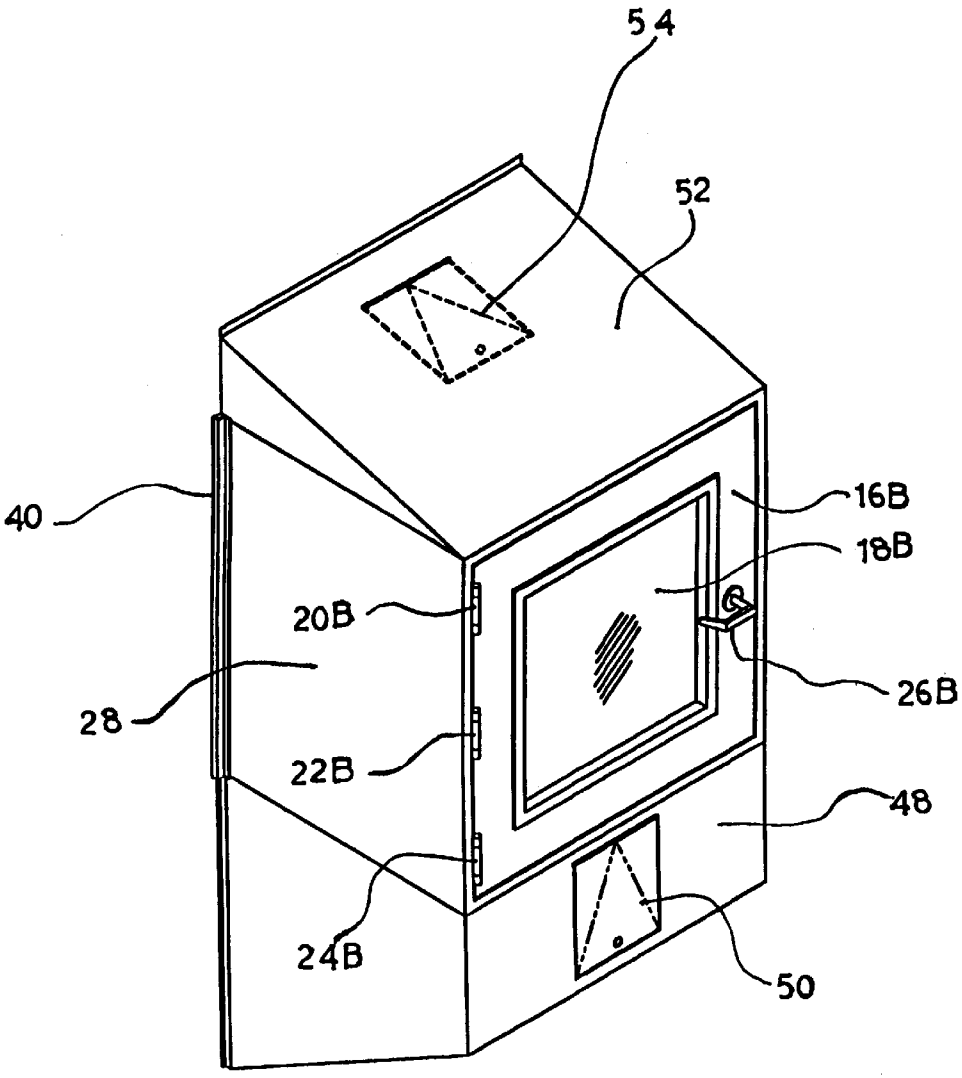
FIG. 3 is a front, perspective view of the box like structure containing hood with access port, skirt with access port, door with sight window, electric mortise lock, hinges and vertical clips.

FIG. 3 is a front perspective view which shows box like structure 28, door 16B, support hinges 20B and 24B, central electric current transfer hinge 22B, electric mortise lock 26B, top hood 52 with access port 54, bottom skirt 48 with access port 50 and vertical Z shaped clip 40. These various elements of the invention have been discussed in the descriptions of FIGS. 1 and 2 above. This view is set forth to depict a more precise relationship of box like structure 28 to the other elements which connect to it.

Figure 4:
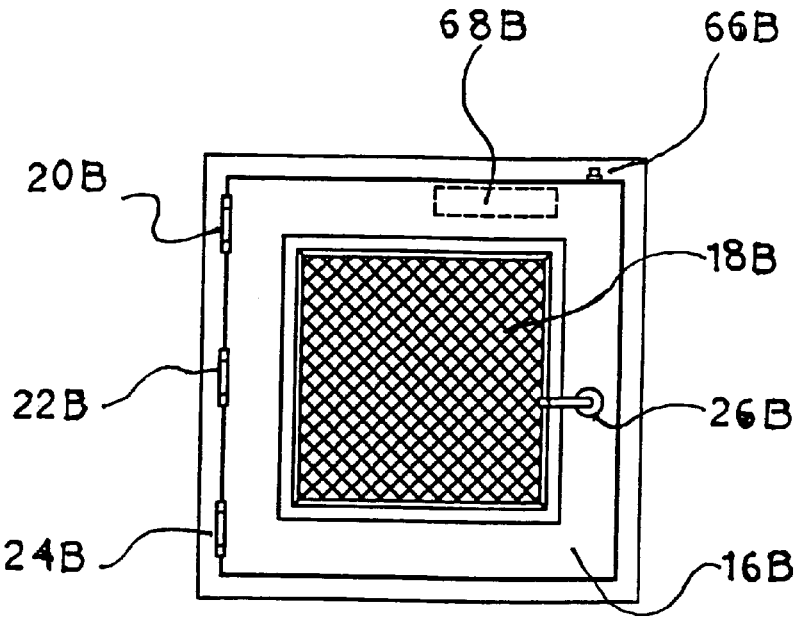
FIG. 4 is a front view of the door shown in FIG. 3 showing the location of the magnet on said door.

FIG. 4 is a front view of second door 16B showing sight window 18B, electric mortise lock 26B, support hinges 20B and 24B, electric current transfer hinge 22B, second sensor containing magnetic proximity sensor 66B and the location of magnet 68B.

First door 16A (not shown) contains identical elements as those depicted in second door 16B. The various functions of the above elements have been described in FIGS. 1 and 2.

Figure 5:
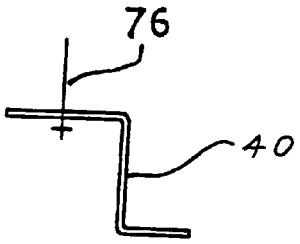
FIG. 5 is a side view of Z shaped vertical clips.

FIG. 5 is a side view of vertical, Z shaped clip 40 containing attachment means 76. Attachment means 76 attaches clip 74 to the right and left sides of box like structure 26 (not shown). It is to be noted that two separate clips are needed, one for each side of said structure. Conventional attachment means, such as screws, nuts and bolts, etc. can be used herein.

Figure 6:
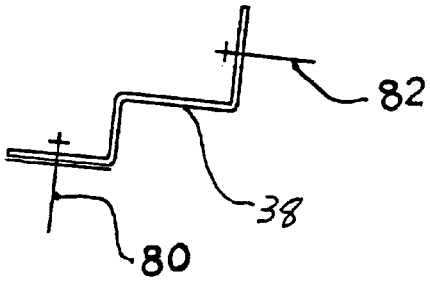
FIG. 6 is a side view of W shaped horizontal clips.

FIG. 6 shows a side view of horizontal, W shaped clip 38 containing attachment means 80 and 82. Horizontal clip 78 attaches to the top and bottom portions of box like structure 28 (not shown) and a wall containing frame 2 (neither shown). Horizontal clip 78 attaches to the top of box like structure 28 using attachment means 80, fits around frame 2 and attaches to wall 64 using attachment means 82, e.g. see FIGS. 1 and 2 in conjunction with FIG. 6. Conventional attachment means such as screws, nuts and bolts, etc. are used herein.

Obviously, many modifications and variations of the invention, as hereinbefore set forth, may be made without departing from the spirit and scope thereof, and therefore only such limitations should be imposed as are indicated in the appended claims.

I claim:

1. A pass through interlock system for sanitized environments comprising a frame adapted to fit in a wall, said frame containing a passage way there through, a top, a bottom, a right side, a left side, a front side and a back side, a first door connected to the front side of said frame; a box like structure juxtaposed on the back side of the frame, said box like structure containing a passage way there through, a top, bottom, right side, left side, front side and back side, a second door oppositely disposed to the first door and connected to the front side of the box like structure, the back side of said box like structure being in removable contact with the back side of said frame; electronic interlocking means connected to the first and second doors, first sensor means attached to the interlocking means of the first and second doors, second sensor means attached near the top of the front of said frame and near the top of the front of said box like structure and near the top of the two doors, the entire system being connected with an interlock controller containing a power source, said interlock controller being programmed to automatically lock one door when the opposite door is opened, wherein the second sensor means comprises a first magnetic sensor located in the top of the front of the frame and a magnet located near the top portion of the first door a second magnetic sensor located near the top of the front of the box like structure and a magnet located near a top portion of the second door.

2. The pass through system for sanitized environments in accordance with claim 1 wherein the electronic interlocking means comprises a modified, electric mortise lock.

3. The pass through system for sanitized environments of claim 1, wherein each of said first and second doors contains two load bearing hinges and a central electronic transfer hinge.

4. The pass through interlock system for sanitized environments in accordance with claim 1, wherein the interlock controller is connected to the first and second sensor means and the electronic interlocking means.

5. The pass through interlock system of claim 1, wherein the box like structure is supported by two angle brackets on the bottom thereof.

6. The pass through interlock system of claim 1, wherein the back of the box like structure is juxtaposed on and held in contact with the back side of the frame by horizontal clips and vertical clips.

7. The pass through interlock system of claim 6, wherein the vertical clips attach the right and left sides of the box like structure with fastening means and the horizontal clips attach to the top and bottom of the box like structure and the wall just above the top and bottom portions of the back of said frame with fastening means.

8. The pass through interlock system for sanitized environments of claim 7, wherein the vertical clips are Z shaped in configuration.

9. The pass through interlock system for sanitized environments in accordance with claim 7, wherein the horizontal clips are W shaped in configuration.

10. The pass through interlock system for sanitized environments of claim 1, wherein the box like structure contains a detachable hood located on the top portion thereof.

11. The pass through interlock system for sanitized environments in accordance with claim 1, wherein the box like structure contains a detachable skirt located on the bottom portion thereof, said skirt covering two angle brackets which provide support for said box like structure.

12. The pads through interlock system of claim 1, wherein the first and second doors contain see through windows.

13. A pass through interlock system for sanitized environments comprising a frame adapted to fit in a wall, said frame containing a first door attached to a front portion of the frame, a backside portion of a box like structure removably connected to a back side of the frame, a second door attached to a front side of the box like structure, said two doors being oppositely disposed to each other, a passage way from the first door through the frame and box like structure to the second door; sensor means consisting of a magnetic sensor attached to a top portion of the front of the frame, a magnet attached to a top portion of the first door, a magnetic sensor attached to a top portion of a front side of the box like structure and a magnet attached to a top portion of the second door; interlocking means attached to said first and second doors consisting of modified electric mortise locks, said electric mortise locks containing outward handles for manually opening and closing said doors, a manual switch contained in each electric mortise lock which interrupts a signal from electronic control means when the handle of the electric mortise lock is manually opened, said interrupted signal activating the electronic control means which in turn activates the lock of the opposing door and locks said opposing door.

14. The pass through interlock system for sanitized environments of claim 13, wherein said sensor means consists of magnetic proximity sensors, one of which is located near a top portion of a front of the frame and one of which is located near a front portion of the box like structure, and two magnets one of which is located near a top portion of each of the first and second doors, said magnetic proximity sensors interrupting a signal from electronic control means when a door is opened, said interrupted signal activating the electronic control means which then activates the lock of the opposing door and locks said opposing door.

15. The pass through interlock system for sanitized environments according to claim 13 wherein the sensor means, manual switches, electronic mortise locks and electronic control means are programmed so as to allow only one of said first and second doors to open at a time.

16. The pass through interlock system for sanitized environments according to claim 13 wherein the first and second doors each contain two load bearing hinges and a central electronic transfer hinge that transfers signals between the electronic mortise lock to the electronic control means.

17. The pass through interlock system for sanitized environments of claim 13, wherein the box like structure is supported by two angle brackets and is removably attached to a back side of the frame by vertical clips that are Z shaped in configuration and horizontal clips that are W shaped in configuration.

18. The pass through interlock system for sanitized environments in accordance with claim 13, wherein the box like structure contains a hood, with access port, removably attached to a top portion thereof, and a skirt, with access port, removably attached to a bottom portion thereof.

* * * * *